US005725209A

United States Patent [19]

Takahashi et al.

[11] Patent Number: 5,725,209

[45] Date of Patent: Mar. 10, 1998

[54] SHEET SUPPLY APPARATUS

[75] Inventors: Masahiro Takahashi, Yokohama; Shigehisa Ishibashi, Kawasaki, both of Japan

[73] Assignee: Canon Kabushiki Kaisha, Tokyo, Japan

[21] Appl. No.: 869,922

[22] Filed: Jun. 5, 1997

Related U.S. Application Data

[63] Continuation of Ser. No. 536,433, Sep. 29, 1995, abandoned.

[30] Foreign Application Priority Data

Sep. 30, 1994 [JP] Japan ..... 6-261130

[51] Int. Cl.[6] ..... B65H 3/52

[52] U.S. Cl. ..... 271/122; 271/109

[58] Field of Search ..... 271/109, 122, 271/314, 272; 492/53, 56

[56] References Cited

U.S. PATENT DOCUMENTS

| | | | |
|---|---|---|---|
| 4,083,092 | 4/1978 | Imperial et al. | 492/56 |
| 4,149,797 | 4/1979 | Imperial | 492/56 |
| 4,192,497 | 3/1980 | Perun et al. | 271/121 |
| 4,287,649 | 9/1981 | Kohler | 492/56 |
| 4,314,006 | 2/1982 | Lentz et al. | 428/494 |
| 4,756,065 | 7/1988 | Carlson | 492/56 |
| 4,804,576 | 2/1989 | Kuge et al. | 492/56 |
| 5,206,992 | 5/1993 | Carlson et al. | 492/56 |
| 5,435,538 | 7/1995 | Billings et al. | 271/122 |

FOREIGN PATENT DOCUMENTS

| | | | |
|---|---|---|---|
| 0131651 | 8/1982 | Japan | 271/122 |
| 2070636 | 3/1990 | Japan | 271/109 |
| 404133936 | 5/1992 | Japan | 271/314 |
| 405024675 | 2/1993 | Japan | 271/109 |
| 406080269 | 3/1994 | Japan | 271/109 |

*Primary Examiner*—H. Grant Skaggs

*Attorney, Agent, or Firm*—Fitzpatrick, Cella, Harper & Scinto

[57] ABSTRACT

The present invention provides a sheet supply apparatus comprising supply rotary means rotated in a sheet supplying direction, and separation rotary means contacted with the supply rotary means and rotated in a sheet returning direction opposite to the sheet supplying direction. Wherein the separation rotary means has a first layer made of elastic porous resin material, a second layer disposed outside of the first layer and made of impregnated resin coating impregnated into a surface of the porous resin material, and outer third layer made of coating resin material.

17 Claims, 7 Drawing Sheets

SHEET SUPPLY APPARATUS

This application is a continuation of application Ser. No. 08/536,433, filed Sep. 29, 1995, now abandoned.

BACKGROUND OF THE INVENTION

1. Field of the Invention

The present invention relates to a sheet supply mechanism used with an image forming apparatus such as a copying machine, a printer and the like, and more particularly, it relates to a retard separation mechanism using an elastic roller.

2. Related Background Art

Conventionally, in electrophotographic image forming apparatuses such as copying machines, printers and the like, a roller formed from porous resin material such as sponge has been used as a roller for conveying a sheet, for example, at a fixing device.

However, since the porous resin material has poor surface strength and poor durability, conventionally, a coating has been applied on the surface of the porous resin material for providing two-layer construction to protect and strengthen the surface of the porous resin material.

As methods for applying the coating, when it is assumed that a layer nearer a center of a roller is referred to as a first layer and a layer remote from the center of the roller is referred to as a second layer, as shown in FIG. 7A, a first method wherein the first layer is formed from porous resin material 105*a* such as sponge and the second layer is formed from impregnated urethane resin 105*b* impregnated into the porous resin material to leave pores or undulation on the surface of the porous resin material 105*a*, or, as shown in FIG. 7B, a second method wherein the first layer is formed from porous resin material 105*a* such as sponge and the second layer is formed as a resin coating 105*c* made of silicone and covering the porous resin material has been used.

An elastic roller (for example, urethane sponge roller) 105 having the impregnated resin coating and constituted according to the first method has greater surface strength than that of a urethane sponge roller having no coating and has an extended service life because paper powder from the sheet can be discharged from a large number of fine pores of the surface of the roller.

In case of an elastic roller 105' having the resin coating 105*c* and constituted according to the first method, a coefficient of friction of the surface of the roller can be increased in comparison with an urethane sponge roller having no coating.

However, in the above-mentioned conventional two-layer elastic rollers 105, 105', the following problems arise. In the elastic roller having the impregnated resin coating, since the many pores (for discharging the paper powder) on the surface of the roller excessively rub the surface of the sheet, a large amount of paper powder is generated from the sheet, with the result that the large amount of paper powder acts as abrasives to wear the surface of the roller, thereby shortening the service life of the roller.

Further, since the coefficient of friction of the surface of the roller depends upon the surface roughness, the initial coefficient of friction cannot be increased.

In the elastic roller 105' having the second layer formed from the resin coating, when the resin is coated on the surface of the porous resin material 105*a* such as sponge, the resin material of the coating is penetrated into the interior of the porous resin material 105*a* through the number of pores, with the result that a thickness of the coating is unstable and apt to be increased during the manufacture of the roller. Thus, in order to enhance the accuracy of the thickness of the coating, the cost of the roller is increased.

SUMMARY OF THE INVENTION

An object of the present invention is to provide a retard separation mechanism which can positively separate various sheets having different coefficients of friction and/or different thicknesses.

Another object of the present invention is to provide a retard separation mechanism in which a load on a roller can be reduced.

To achieve the above objects, the present invention provides a sheet supply apparatus comprising a supply rotary means rotated in a sheet supplying direction, and a separation rotary means contacted with the supply rotary means and rotated in a sheet returning direction opposite to the sheet supplying direction, and wherein the separation rotary means has a first layer made of elastic porous resin material, a second layer disposed outside of the first layer and made of impregnated resin coating impregnated into a surface of the porous resin material, and outer third layer made of coating resin material.

DESCRIPTION OF THE PREFERRED EMBODIMENTS

The present invention will now be explained in connection with embodiments thereof with reference to the accompanying drawings.

Figure 1A:
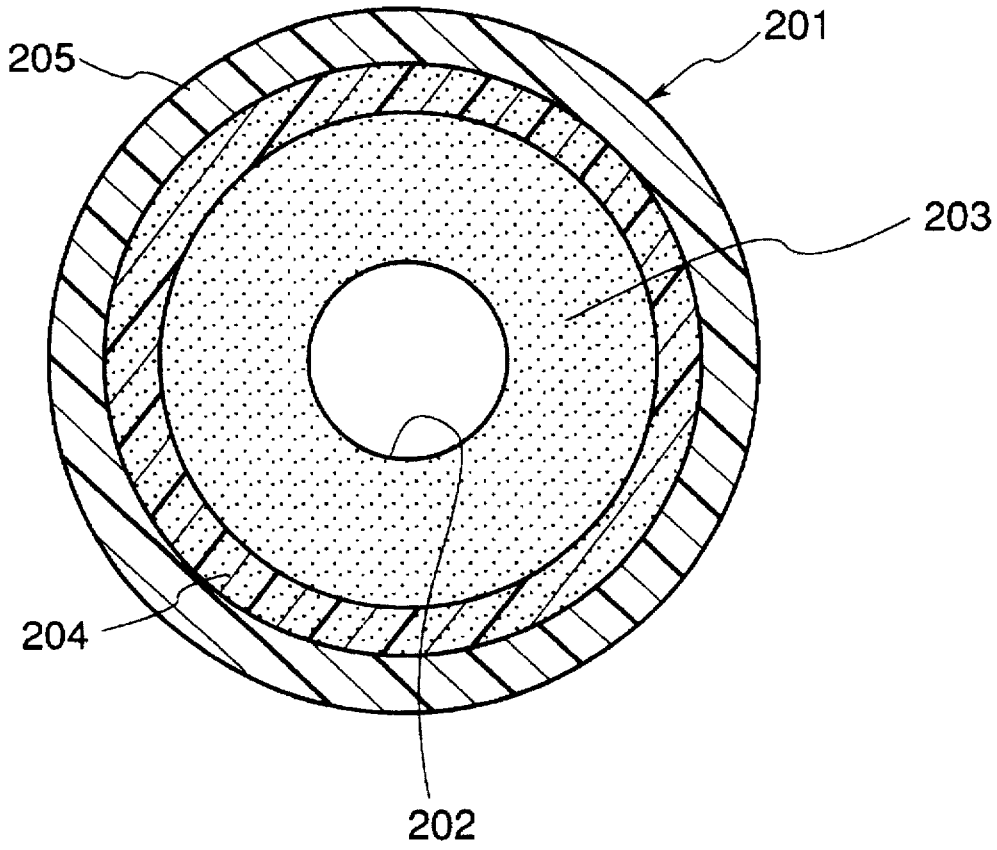
FIGS. 1A and 1B are sectional views showing an elastic roller according to a first embodiment of the present invention.
Figure 1B:
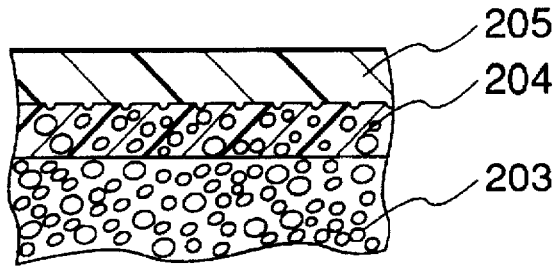

FIGS. 1A and 1B are sectional views showing a characteristic of an elastic roller to be used in the present invention.

The elastic roller 201 has a cylindrical hollow member having a central bore 202 through which a roller shaft is passed and within which the roller shaft is secured and constituted by three layers. When it is assumed that these three layers (inner, intermediate and outer layers) are referred to as first, second and third layers, respectively, the first layer is formed from elastic porous resin material 203, the second layer comprises an impregnated resin coating layer 204 obtained by impregnating resin into the surface of the porous resin material. Further, the third layer is formed from coating resin material 205.

The first layer is a base layer for determining hardness of the elastic roller 201 and is constituted by the porous resin material 203 having hardness smaller than that of normal rubber rollers. The porous resin material 203 may be foamed resin such as polyurethane sponge, silicone sponge and the like. Although the kind of the porous resin material 203 is selected in accordance with a using condition, particularly, the polyurethane sponge is preferable in the point that it is cheaper than other porous resin materials and is usually used widely.

The second layer serves to maintain and strengthen the strength of the surface of the porous resin material 203 of the first layer and serves as a foundation layer for stabilizing a thickness of the coating resin material 205 of the third layer. The thickness of the second layer is appropriately selected not to affect a bad influence upon the hardness and elasticity of the porous resin material 203 of the first layer.

The impregnated resin material constituting the impregnated resin coating layer 204 as the second layer may be resin material (for example, impregnated polyurethane resin, silicone resin and the like) capable of being impregnated into the surface of the porous resin material 203. In particular, when the polyurethane resin is used, it is more advantageous since it is cheaper than other porous resin materials and is usually used widely.

The third layer is a portion contacted with the sheet and determines coefficient of friction of the elastic roller 201. The thickness of the third layer is also appropriately selected not to affect a bad influence upon the hardness and elasticity of the porous resin material 203 of the first layer.

The coating resin material 205 of the third layer, for example, may be special rubber such as silicone rubber, EPDM, chloroprene rubber (CR), nitrile rubber (NBR), ethylene-propylene rubber (EPDM), butyl rubber (IIR) and the like, or resin such as epichlorohydrin, acrylic resin, fluororesin and the like which can be increased the initial coefficient of friction. In particular, the silicone and EPDM are advantageous since they are easily available and have good workability in comparison with other resin materials.

Figure 2A:
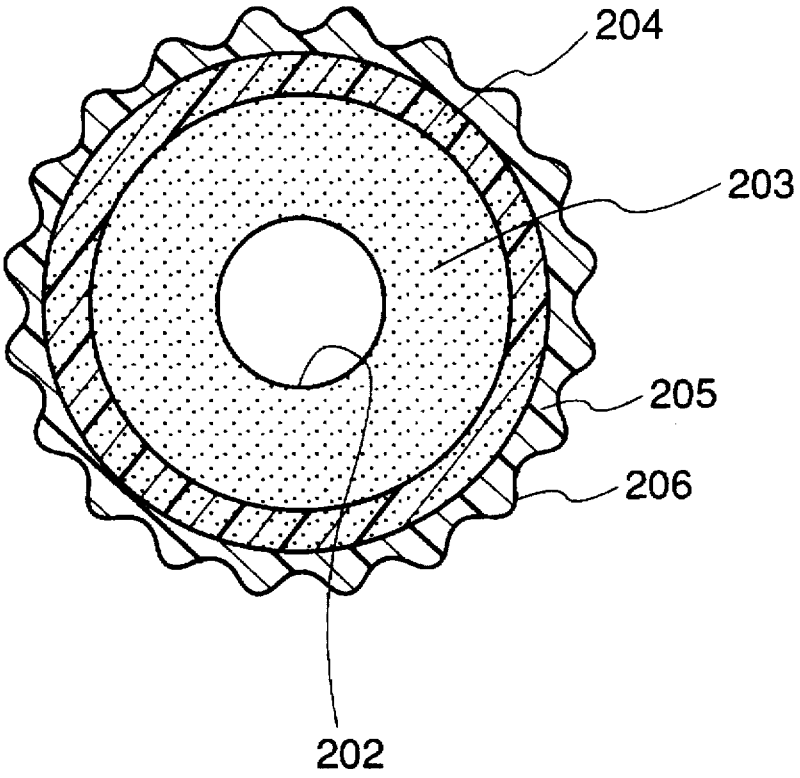
FIGS. 2A and 2B are sectional views showing an elastic roller according to another embodiment of the present invention.
Figure 2B:
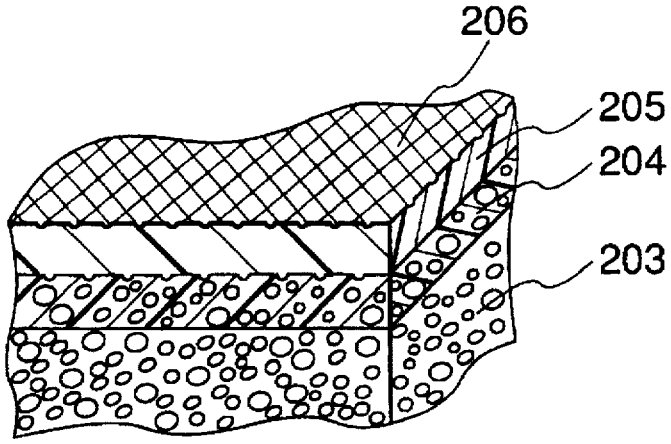

Further, as shown in FIG. 2, it is preferable that the surface of the coating resin material 205 of the third layer is worked to form indentation 206 such as ground rough surface or knurl.

As mentioned above, according to the elastic roller 201 of the present invention, since the first layer is constituted by the porous resin material 203 such as polyurethane sponge, the hardness of the roller can be set to the same hardness as that of the conventional sponge roller, and, the initial coefficient of friction of the surface of the roller can be increased by using the coating resin material 205 (such as silicone coating or EPDM coating) of the third layer. The initial coefficient of friction is relatively determined in accordance with the using condition, and is not an absolute value. In accordance with the selected coefficient of friction, the coating resin material 205 is appropriately selected.

In comparison with the conventional two-layer sponge roller impregnated by the urethane resin with the three-layer elastic roller 201 having the outer silicone coating according to the illustrated embodiment, it was found that, when it is assumed that the coefficient $\mu$ of friction of the conventional roller is 1.0, the coefficient $\mu$ of friction of the elastic roller having the outer silicone coating according to the illustrated embodiment becomes 1.6.

Further, by using the impregnated resin coating layer 204 of the second layer made of the urethane resin and the like, the strength of the surface of the porous resin material 203 of the first layer is maintained, and, by using the second layer, when the third layer such as the silicone coating is formed, the coating resin material 205 is prevented from impregnating into the porous resin material 203, thereby making the thickness of the coating uniform and improving the stable formation of the coating.

Further, by forming the indentation 206 on the surface of the coating resin material 205 (such as silicone coating) of the third layer, the coefficient of friction of the surface of the roller can be increased while maintaining the paper powder discharge ability provided by the impregnated resin coating layer of the second layer.

Figure 3:
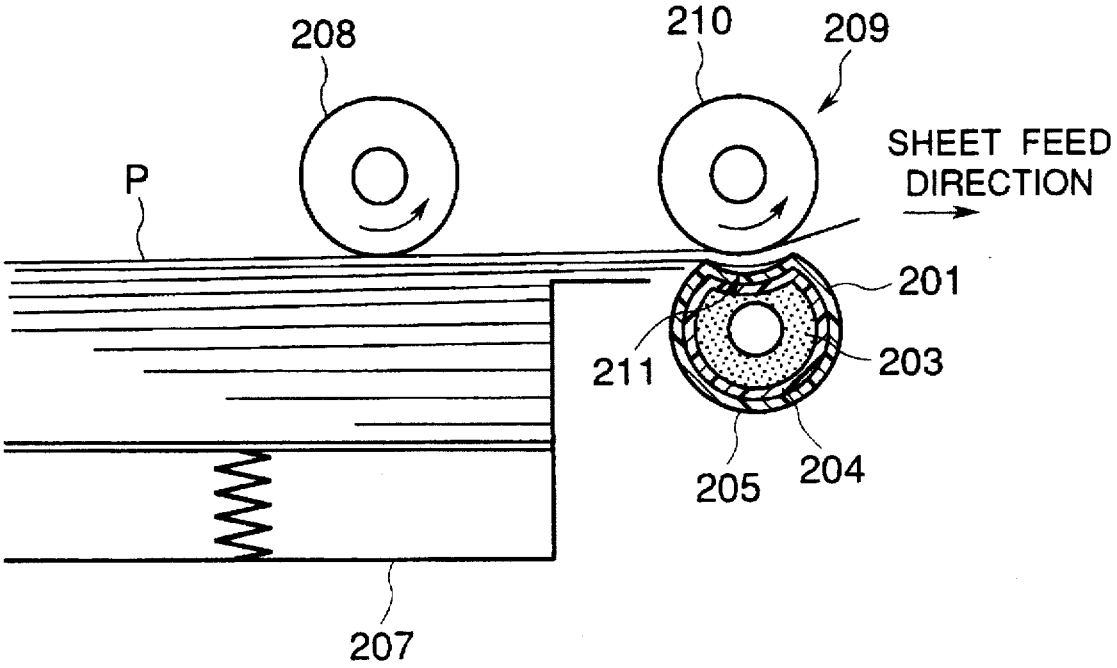
FIG. 3 is a schematic sectional view of a sheet supply apparatus using the elastic roller according to the present invention.

FIG. 3 shows an example of a sheet supply apparatus according to the present invention in which the above-mentioned elastic roller 201 is incorporated into the retard separation mechanism. More particularly, the sheet supply apparatus includes a sheet containing means 207 for containing and supporting sheets P, and a feed-out means 208 for feeding out the sheet P from the sheet containing means 207. And, the sheets P fed out by the feed-out means 208 are separated one by one by means of the retard separation mechanism 209.

The retard separation mechanism 209 comprises a sheet supply roller (supply rotary means) 210 rotated in a sheet supplying direction (sheet feed direction), and the above-mentioned elastic roller 201 acting as a separation rotary means contacted with the sheet supply roller 210 and rotated in a sheet returning direction to return the sheet P to the sheet containing means 207. The sheet supply roller 210 is formed from rubber material such as EPDM, and hardness of this roller is selected to be greater than hardness of the elastic roller 201. In a drive and transmit system for the elastic roller 201, for example, a torque limiter (not shown) is provided so that the drive torque for the elastic roller 201 is limited to a predetermined torque value.

In this way, by using the elastic roller 201 as a retard roller of the retard separation mechanism 209, the following advantage can be obtained.

Figure 4:
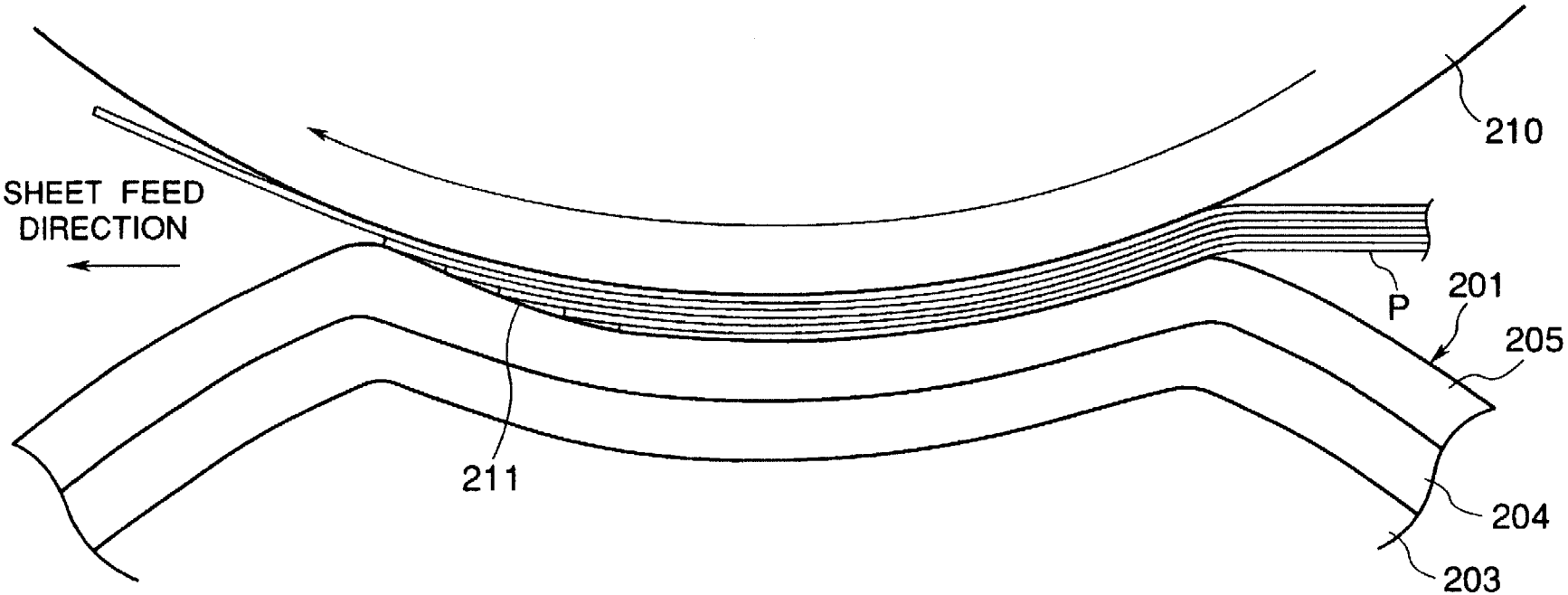
FIG. 4 is an enlarged view for explaining a retard separation mechanism.

As shown in FIG. 4, since the sheet supply roller 210 is formed from the rubber material such as EPDM, when the elastic roller 201 is urged against the sheet supply roller, the porous resin material 203 of the first layer (base layer) of the elastic roller (retard roller) 201 is elastically deformed so that a nip 211 between these rollers is concave toward the elastic roller 201.

Accordingly, when a plurality of sheets P are entered into the nip 211, tip ends of the entered sheets are deviated or displaced in a stepped fashion so that all of the tip ends of the entered sheets P are directly contacted with the elastic roller 201, with the result that various sheets P having different thicknesses and/or different coefficients of friction can be positively separated from each other by the elastic roller 201. In particular, since the surface of the elastic roller 201 contacted with the sheets is constituted by the coating resin material 208 of the third layer, the coefficient of friction thereof is greater than that of the porous resin material 203 of the first layer, with the result that the separation of the sheets can be effected more positively.

Further, since the sheets P relatively displaced by the nip 211 are positively gripped in the nip 211 during the separating operation, any sheet is not returned to the sheet containing means, thereby providing stable separation.

Figure 5A:
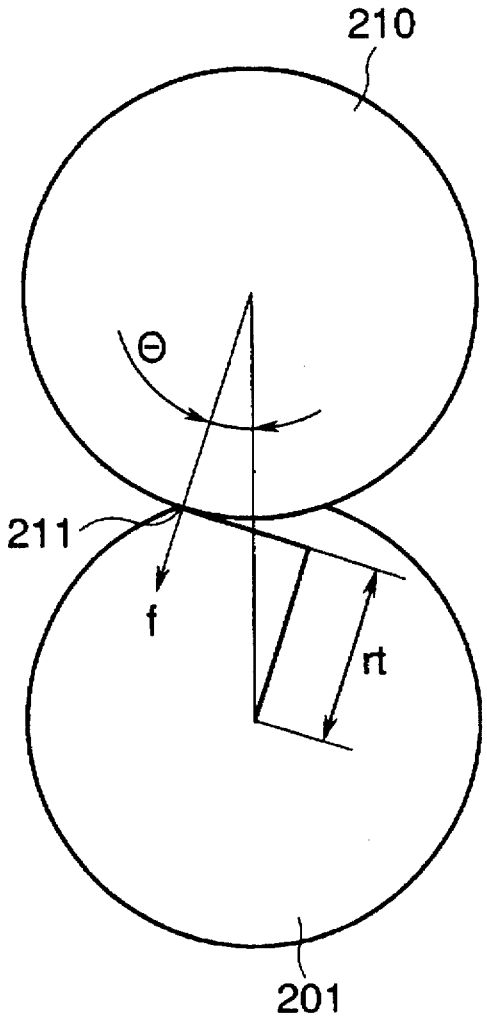
FIGS. 5A and 5B are views for explaining forces acting on a nip of the retard separation mechanism.
Figure 5B:
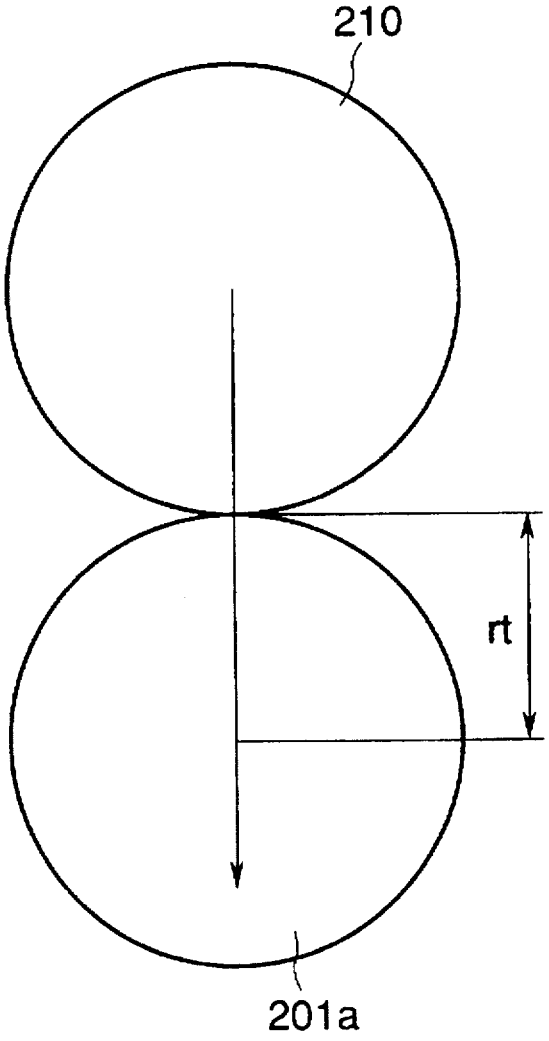

When the nip 211 is fully considered along the circumferential direction, as shown in FIGS. 5A and 5B, since the nip 211 is greater than a nip in the case where an elastic roller 201*a* made of EPDM is used (FIG. 5B), stress f actually acting on a contact position spaced apart from a center of the nip 211 by an angle θ and effective radius rt at that position are varied. Thus, idle rotation torque of the drive system for the elastic roller 201 can be reduced, and, thus, the load acting on the roller can be reduced.

Figure 6:
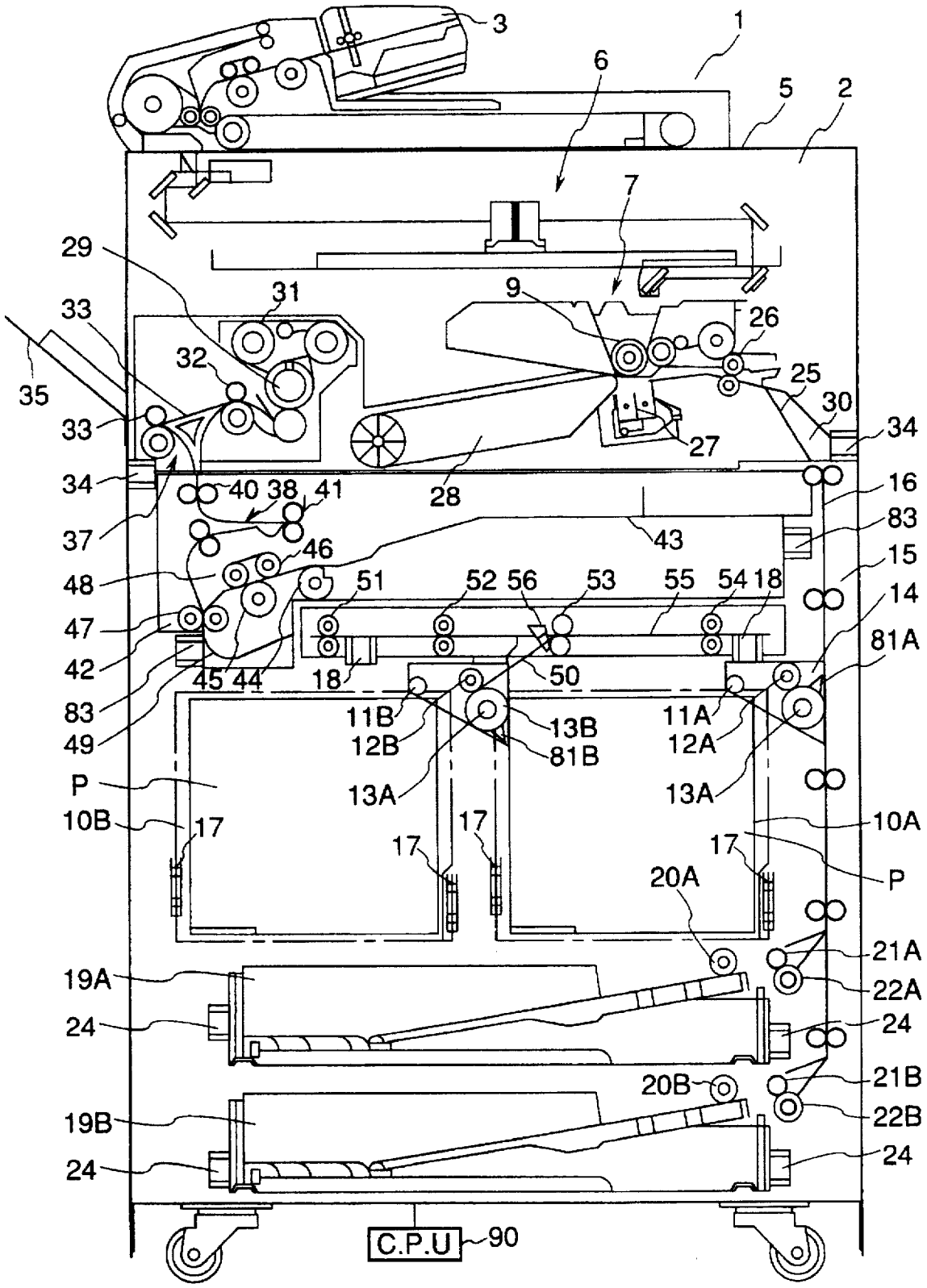
FIG. 6 is a sectional view of an image forming apparatus having a sheet supply portion using the elastic roller according to the present invention.
Figure 7A:
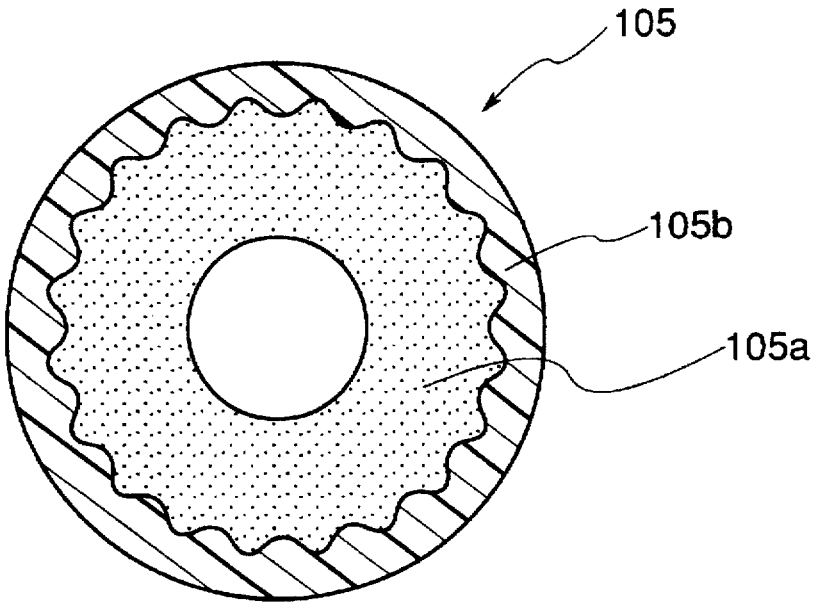
FIG.7A PRIOR ART
FIGS. 7A and 7B are views showing conventional two-layer elastic rollers.
Figure 7B:
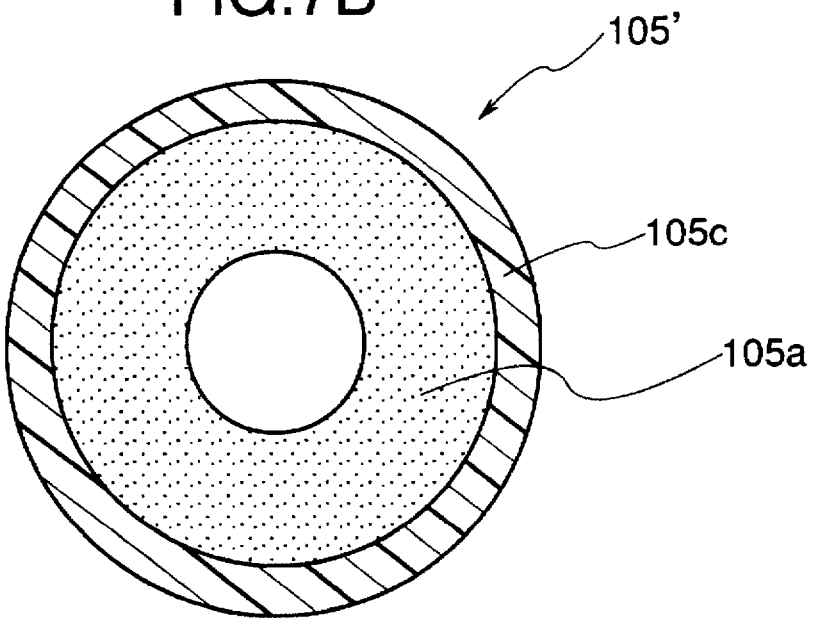

FIG. 6 shows an example of an image forming apparatus in which the above-mentioned sheet supply apparatus is applied to a sheet supply portion of the image forming apparatus. First of all, the schematic construction of the entire image forming apparatus will be explained.

In FIG. 6, an original (not shown) is automatically supplied from an automatic original supplying apparatus 3 onto a platen glass 5 provided on a body 2 of a copying machine 1 as the image forming apparatus. The original is then scanned by an optical system 6, thereby forming a latent image on a photosensitive drum 9 in an image forming portion (image forming means) 7. The latent image is developed to form a toner image on the photosensitive drum 9.

Within the body 2 of the copying machine, there are disposed a right sheet supply deck 10A and a left sheet supply deck 10B which can contain a plurality of sheets P, respectively. From these sheet supply decks 10A, 10B, the sheet is selectively supplied by means of sheet supply portion 81A or 81B which includes a sheet supply roller (sheet supply means) 11A (11B), a convey roller 12A (12B), and a separation roller (separation rotary means) 13A (13B). The convey rollers 12A, 12B and the separation rollers 13A, 13B constitute the retard separation mechanisms, respectively, and the elastic rollers of the present invention are used as the separation rollers 13A, 13B.

The sheets P supplied from the sheet supply decks 10A, 10B are conveyed to a regist introduction path 16 through right and left dark paths (second convey path) 14, 50, and a both-face path (first convey path) 15, respectively. The sheet supply decks 10A, 10B are guided by deck guide rails 17 in a front loading fashion. The both-face path 15 is guided by both-face guide rails 18 so that it can be drawn forwardly of the apparatus 2.

Below the sheet supply decks 10A, 10B, there are disposed an upper sheet supply cassette 19A and a lower sheet supply cassette 19B which can contain a small number of sheets, respectively. From these cassettes 19A, 19B, the sheet P is selectively supplied to the regist introduction path 16 through a sheet supply roller 20A (20B), a convey roller 21A (21B) and a separation roller 22A (22B). The sheet supply cassette 19A, 19B are guided by cassette rails 24 in a front loading fashion.

The convey rollers 21A, 21B and the separation rollers 22A, 22B constitute the retard separation mechanism, and the elastic rollers of the present invention are used as the separation rollers 22A, 22B. At a downstream side of the regist introduction path 16, there are disposed a pre-regist guide 25 and a pair of regist rollers 26 which serve to guide the sheet sent from the regist introduction path 16.

The image forming portion (7, 30) comprises an upper image forming portion 7 including the photosensitive drum 9, and a lower image forming portion 30 including a transfer separation charger portion 27, a convey portion 28, a fixing portion 31 and a discharge path 37. The image forming portion 30 is guided by body guide rails 34 in a front loading fashion. The toner image formed on the photosensitive drum 9 is transferred onto the sheet P conveyed by the regist rollers 26 by means of the transfer separation charger portion 27. Then, the sheet is sent, by the convey portion 28, to the fixing portion 31, where the toner image is fixed to the sheet by a fixing roller 29.

In a one-face copy mode in which the image is formed on one surface of the sheet, the sheet P on which the image was formed is discharged onto a discharge tray 35 by means of the discharge path 37 including a pair of inner discharge rollers 32, a switching member 36 for switching convey paths, and a pair of outer discharge rollers 33.

A both-face unit 42 including an intermediate tray 43 is disposed below the image forming portion 30. The both-face unit 42 is guided by guide rails 83 in a front loading fashion.

In a both-face copy mode or a multi copy mode, the sheet P on which the image was formed is sent to a reverse rotation path 38 by the pair of inner discharge rollers 32 and the switching member 36 and then is discharged onto the intermediate tray 43 through a pair of convey rollers 40, 41.

The sheets P temporarily stacked on the intermediate tray 43 are supplied one by one by a sheet supply roller 44 from the lowermost one, and the double-fed sheets (if any) are separated one by one by means of a convey roller 45 and a separation belt 46. The sheet supply roller 44, convey roller 45 and separation belt 46 constitute a sheet re-supply portion.

In the both-face copy mode, the sheet P re-supplied from the intermediate tray 43 is sent to the both-face path 15 by means of a re-supply path 49 including a pair of convey rollers 47 and a switching member 48 for switching convey paths. Then, the sheet P is sent, through the both-face path 15 and the regist introduction path 16, to the image forming portion 30, where the toner image is formed on the other surface of the sheet. Thereafter, the sheet is discharged onto the discharge tray 35 through the convey portion 28, fixing portion 31 and discharge path 37.

Next, the sheet convey control when the sheet is supplied from the left sheet supply deck 10B will be explained.

The both-face path 15 includes pairs of convey rollers 51, 52, 53, 54 and a both-face guide 55. A sheet detection member (first detection means) 56 is disposed immediately at an upstream side of the pair of convey rollers 53 (second convey means). When the supply of sheet from the left sheet supply deck 10B is selected by the operator and the image forming operation is started, under the control of a CPU (control means) 90, the sheet supply roller 11B is rotated to supply the sheet from the left sheet supply deck 10B. As shown in FIG. 6, the supplied sheet P is conveyed through the both-face path 15 by means of the pair of convey rollers 53.

In this case, if a tip end (in a sheet conveying direction) of the sheet P is not detected by the detection means 56 before a predetermined time T1 or if a trail end (in a sheet conveying direction) of the sheet P is not detected by the detection means 56 before a predetermined time T2, it is judged that the sheet jam occurs, and the CPU 90 stops the image forming operation of the apparatus. Further, if a time period from when the sheet P is detected by the detection member 56 to when the image forming operation is stopped is shorter than a predetermined time period, the CPU 90 controls so that the sheet P is conveyed by a predetermined amount from a position where the sheet is stopped.

Incidentally, in FIG. 6, there is no constructual element blocking a front side of the both-face path 15 between the pair of convey rollers 53 and the convey roller 12B and separation roller 13B and no constructual element blocking a front side of the left sheet supply deck path 50 and supporting the convey roller 12B.

In the illustrated embodiment, while an example that the elastic roller of the present invention is applied to the separation rotary means of the retard separation mechanism of the sheet supply apparatus was explained, the elastic roller may be applied to a sheet feed-out roller of a sheet supply apparatus. For example, the elastic roller can be used in the convey system of the above-mentioned image forming apparatus.

While the present invention has been described with respect to what is presently considered to be the preferred embodiments, it is to be understood that the invention is not limited to the disclosed embodiments. The present invention is intended to cover various modifications and equivalent arrangements included within the spirit and scope of the appended claims.

What is claimed is:

1. A sheet supply apparatus comprising:

supply rotary means rotated in a sheet supplying direction; and separation rotary means contacted with said supply rotary means and rotated in a sheet returning direction opposite to the sheet supplying direction, said separation rotary means having an inner first layer made of elastic porous resin material, a second layer disposed outside of the first layer and made of art impregnated resin coating impregnated into a surface of the porous resin material, and an outer third layer made of a coating resin material, a hardness of the inner first layer being selected smaller than hardness of said supply rotary means so that a periphery of said separation rotary means is elastically concaved by said supply rotary means.

2. A sheet supplying apparatus according to claim 1, wherein said first layer is constituted by polyurethane sponge, said second layer is constituted by impregnating polyurethane resin into said first layer, and said third layer is constituted by silicone rubber.

3. A sheet supply apparatus according to claim 2, wherein said supply rotary means is formed from EPDM.

4. A sheet supply apparatus according to claim 2, wherein said third layer is provided at its outer surface with indentation.

5. A sheet supply apparatus according to claim 1, wherein said first layer is constituted by polyurethane sponge, said second layer is constituted by impregnating polyurethane resin into said first layer, and said third layer is constituted by EPDM.

6. A sheet supply apparatus according to claim 5, wherein said supply rotary means is formed from EPDM.

7. A sheet supply apparatus according to claim 5, wherein said third layer is provided at its outer surface with indentation.

8. A sheet supply apparatus according to claim 1, wherein said supply rotary means is formed from EPDM.

9. A sheet supply apparatus according to claim 1, wherein said third layer is provided at its outer surface with indentation.

10. A sheet supply apparatus according to claim 9, wherein said indentation is ground rough surface or knurl.

11. A sheet supply apparatus according to claim 1, wherein a torque limiter is disposed in a drive transmit system of said separation rotary means.

12. A sheet supply apparatus according to claim 1, wherein at least one of said supply rotary means and said separation rotary means is constituted by a roller.

13. An image forming apparatus comprising:

supply rotary means rotated in a sheet supplying direction;

separation rotary means contacted with said supply rotary means and rotated in a sheet returning direction opposite to the sheet supplying direction, said separation rotary means having an inner first layer made of elastic porous resin material, a second layer disposed outside of the first layer and made of impregnated resin coating impregnated into a surface of the porous resin material, and an outer third layer made of a coating resin material, a hardness of the inner first layer being selected smaller than hardness of said supply rotary means so that a periphery of said separation rotary means is elastically concaved by said supply rotary means; and image forming means for forming an image on a sheet separated by said supply rotary means and said separation rotary means.

14. A sheet supply apparatus comprising:

supply rotary means rotated in a sheet supplying direction; and separation rotary means contacted with said supply rotary means and rotated in a sheet returning direction opposite to the sheet supply direction, said separation rotary means having an inner first layer made of elastic porous resin material, a second layer disposed outside of the first layer and made of impregnated resin coating impregnated into a surface of the porous resin material, and an outer third layer made of silicone rubber, an outer surface of which is formed with indentation in order to increase a coefficient thereof.

15. A sheet supply apparatus according to claim 14, wherein the indentation is ground rough.

16. A sheet supply apparatus according to claim 14, wherein the indentation is a knurl.

17. An image forming apparatus comprising:

supply rotary means rotated in a sheet supplying direction;

separation rotary means contacted with said supply rotary means and rotated in a sheet returning direction opposite to the sheet supply direction; and image forming means for forming an image on a sheet supplied and separated by said supply rotary means and said separation rotary means;

wherein said separation rotary means has an inner first layer made of an elastic porous resin material, a second layer disposed outside of the first layer and made of impregnated resin coating impregnated into a surface of the porous resin material, and outer third layer made of silicone rubber an outer surface of which is formed with indentation in order to increase a coefficient thereof.

* * * * *

UNITED STATES PATENT AND TRADEMARK OFFICE

CERTIFICATE OF CORRECTION

PATENT NO. : 5,725,209
DATED : March 10, 1998
INVENTOR(S) : Masahiro TAKAHASHI, et al.

It is certified that error appears in the above-identified patent and that said Letters Patent is hereby corrected as shown below:

Title page, item [56]:

References Cited, Foreign Patent Documents, first column, delete in its entirety and insert therefor:
--57-131651
02-070636
04-133936
05-024675
06-080269--.

Column 4, line 55, delete "208" and insert therefor --205--.

Column 7, line 22, delete "art" and insert therefor --an--.

Column 8, line 54, after "and", insert --an--;
Line 55, after "rubber", insert a comma (",").

Signed and Sealed this

Fifteenth Day of September, 1998

Bruce Lehman

*Attest:*

BRUCE LEHMAN

*Attesting Officer*

*Commissioner of Patents and Trademarks*